US008753585B2

(12) United States Patent
Ohman et al.

(10) Patent No.: US 8,753,585 B2
(45) Date of Patent: Jun. 17, 2014

(54) CONTROLLED FLOW ASSAY DEVICE AND METHOD

(75) Inventors: Per Ove Ohman, Uppsala (SE); Ib Mendel-Hartvig, Uppsala (SE)

(73) Assignee: Johnson & Johnson AB (SE)

( * ) Notice: Subject to any disclaimer, the term of this patent is extended or adjusted under 35 U.S.C. 154(b) by 0 days.

(21) Appl. No.: 12/796,351

(22) Filed: Jun. 8, 2010

(65) Prior Publication Data

US 2010/0248394 A1 Sep. 30, 2010

Related U.S. Application Data

(62) Division of application No. 10/560,214, filed as application No. PCT/SE2005/000787 on May 26, 2005, now abandoned.

(30) Foreign Application Priority Data

Jun. 2, 2004 (SE) ..... 0401424

(51) Int. Cl.
*B01L 3/00* (2006.01)

(52) U.S. Cl.
USPC ..... 422/507; 436/180; 422/502; 422/503; 422/504

(58) Field of Classification Search
USPC ..... 436/180; 422/502–504, 507
See application file for complete search history.

(56) References Cited

U.S. PATENT DOCUMENTS

| | | | |
|---|---|---|---|
| 5,837,115 | A | 11/1998 | Austin et al. |
| 5,885,527 | A | 3/1999 | Buechler |
| 6,143,576 | A | 11/2000 | Buechler |
| 6,156,270 | A | 12/2000 | Buechler |
| 6,368,871 | B1 | 4/2002 | Christel et al. |
| 6,762,059 | B2 | 7/2004 | Chan et al. |
| 6,767,510 | B1 | 7/2004 | Buechler |
| 2003/0035758 | A1 | 2/2003 | Buechler et al. |
| 2004/0077103 | A1 | 4/2004 | Buechler |
| 2004/0126767 | A1 | 7/2004 | Anderberg et al. |
| 2005/0136552 | A1 | 6/2005 | Buechler |

FOREIGN PATENT DOCUMENTS

| | | |
|---|---|---|
| EP | 0568024 A2 | 11/1993 |
| EP | 0348006 | 12/1993 |
| EP | 1120164 | 8/2001 |

(Continued)

OTHER PUBLICATIONS

Debar, Michael et al., Fabrication and Performance Testing of a Steady Thermocapillary Pump with no Moving Parts, Technical Digest for the Fifteenth IEEE International Conference on Micro Electro Mechanical Systems, U.S., Jan. 2002. pp. 109-112.

(Continued)

*Primary Examiner* — Shogo Sasaki

(74) *Attorney, Agent, or Firm* — Hiscock & Barclay, LLP

(57) ABSTRACT

A device for handling liquid samples, comprising a flow path with at least one zone for receiving the sample, and a transport or incubation zone, said zones connected by or comprising an area having projections substantially vertical to its surface, said device provided with a sink with a capacity of receiving said liquid sample, said sink comprising an area having projections substantially vertical to its surface, and said sink being adapted to respond to an external influence regulating its capacity to receive said liquid sample.

12 Claims, 3 Drawing Sheets

(56) References Cited

FOREIGN PATENT DOCUMENTS

Figure 1:
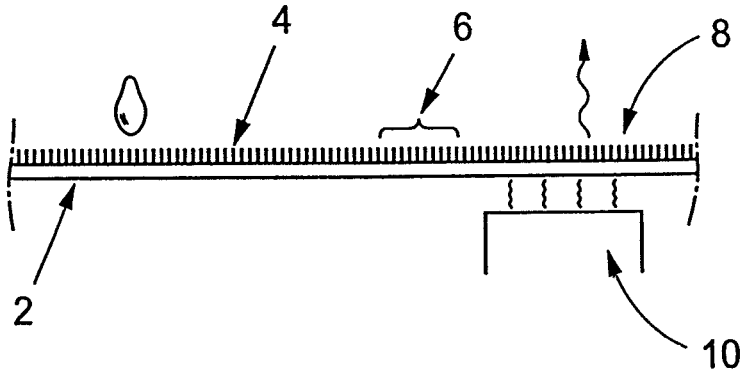

| | | | |
|---|---|---|---|
| EP | 1371984 | | 12/2003 |
| EP | 0985146 | | 3/2005 |
| JP | 6-10900 | A | 1/1994 |
| JP | 2002-214243 | A | 7/2002 |
| JP | 2003004752 | A | 1/2003 |
| JP | 2004045357 | A | 2/2004 |
| WO | WO-92/01226 | | 1/1992 |
| WO | WO-03/103835 | | 12/2003 |
| WO | WO-2004/037374 | | 5/2004 |
| WO | WO-2005/089082 | | 9/2005 |

OTHER PUBLICATIONS

International Search Report mailed Sep. 6, 2005, for international patent application No. PCT/SE2005/000787, filed May 26, 2005, 3 pages.

Written Opinion mailed Sep. 6, 2005, for international patent application No. PCT/SE2005/000787, filed May 26, 2005, 3 pages.

International Search Report mailed Jul. 26, 2005, for international patent application No. PCT/SE2005/000429, filed Mar. 23, 2005, 4 pages.

Written Opinion mailed Jul. 26, 2005 for international patent application No. PCT/SE2005/000429, filed Mar. 23, 2005, 4 pages.

Japanese Office Action for JP Application No. 2011-178867; mailed Jun. 18, 2013; 6 pages.

CONTROLLED FLOW ASSAY DEVICE AND METHOD

CROSS REFERENCE TO RELATED APPLICATIONS

This application is a divisional application of U.S. Ser. No. 10/560,214, now abandoned which is a National Stage application based upon International application number PCT/SE2005/000787, filed May 26, 2005, which claims priority to Swedish Application Serial No. SE 0401424-7 filed Jun. 2, 2004, each of which are hereby incorporated by reference in their entirety.

The present invention relates to the field of assay devices or assay systems including components thereof, for use in the detection of one or more analytes in a sample, as well as method for the use of said device or component, and methods for detection of an analyte, using said device. The invention in particular relates to such devices and such methods where the flow of liquids is controlled.

BACKGROUND

Analytical and diagnostic determinations are frequently performed on liquid samples, comprising in addition to the analyte of interest, also countless other components, in solution and/or in particulate form, which often interfere with the handling of the sample and may influence the quantitative or qualitative determination of the analyte.

For example, numerous clinical diagnostic methods are based on the detection of an analyte in a biological sample. Frequently, such detection is achieved in a disposable assay device, allowing rapid and simple diagnosis. One important application is the wide field of immunology, where analytes are detected with the aid of specific antibodies, capable of binding to the analytes and forming detectable complexes, usually with the aid of ligands aiding the detection.

When performing a test using a biological sample from a patient, in particular a blood sample, many factors need to be considered. Whole blood is prone to clotting, reducing or preventing the desired flow of the sample in the assay device. The red blood cells, even in the absence of clotting, may inhibit or retard flow. Further, red blood cells may inhibit binding between specific binding pair members. Red blood cells also have enzymatic activity, which, depending on the assay employed, may interfere with the signal produced.

Unfortunately, red blood cells present in whole blood also scatter and absorb light thus interfering with assay methodologies which measure either reflected or transmitted light. Also other cells may interfere with particular determinations; for example, cholesterol determinations can be effected by cholesterol present in cell membranes.

Further, the red cell fraction takes up a considerable volume of the sample, in some cases as much as half the volume. Importantly, this fraction, also called hematocrit, may vary between different individuals and even in the same individual, between different measurements. This in turn may influence the accuracy and/or the repeatability of the determinations.

Consequently many assays involve a step of separating the red blood cells from the plasma, whereupon the assay is carried out on plasma or serum. When the separation is performed before clotting, plasma is obtained. When clotting has occurred before separation, serum is obtained.

The red blood cells can be separated from plasma through centrifugation, which however requires relatively large volume of sample, and the use of a centrifuge. This is also time consuming and constitutes an additional step of handling the sample, which increases cost and complexity, and which should be avoided in particular when potentially contagious blood-borne pathogens are involved. Further, the risk of the sample being contaminated by the individuals handling it, cross-contaminated by parallel sample or mixed up with other samples is increased.

What is said above regarding whole blood samples and red blood cells applies also, with necessary adaptations, to other biological samples, where cells, cell debris, fibres, or other unwanted particles etc., may interfere with the determination and should therefore preferably be separated before or during the reaction or determination leading to the detection of the analyte.

The most common type of disposable assay device consists of a zone or area for receiving the sample, a reaction zone, and optionally a transport or incubation zone connecting the receiving and reaction zone, respectively. These assay devices are known as chromatography assay devices or simply referred to as strip tests. They employ a porous material defining a path for fluid flow capable of supporting capillary flow, e.g. a filter material. The sample-receiving zone frequently consists of a more porous material, capable of absorbing the sample, and, when the separation of blood cells is desired, effective to trap the red blood cells. Examples of such materials are fibrous materials, such as paper, fleece, gel or tissues, comprised e.g. of cellulose, wool, glass fibre, asbestos, synthetic fibres, polymers or mixtures of the same. The transport or incubation zone commonly consists of the same or similar materials, often with another porosity then the sample-receiving zone. Likewise, the reaction zone, which may be integrated with the incubation zone, or constituting the most distal part thereof, commonly consists of similar, absorbing fibrous materials, or any of the above listed materials.

In a conventional assay device or strip test, the porous material (-s) is (are) assembled on a carrier, such as a strip of thermoplastic material, paper, cardboard or the like. Further, a cover can be provided, said cover having at least one aperture for receiving the sample, and an aperture or transparent area for reading the result of the assay.

Nitrocellulose materials are also frequently used as the matrix constituting the transport or reaction zone, connecting the receiving zone and the reaction zone. A significant disadvantage with nitrocellulose is its high non-specific binding of proteins and other bio-molecules. Present test strips however often handle a surplus of sample, reducing the influence of this binding. It is however desirable to minimise the sample volume, in line with the tendency to miniaturize the entire test, including minimising the amounts of reagents without compromising accuracy and reliability.

PRIOR ART

EP 1 371 984 discloses a chromatographic assay device and method for detecting the presence of an analyte in a sample of whole blood, utilizing a red blood cell separating agent to aggregate red blood cells and permit plasma or serum to flow by capillary action. The carrier material is exemplified as a paper (fibrous), or membranes of cellulose, fiberglass, cloth, both naturally occurring and synthetic, as well as porous gels.

Although frequently used and well known in the art, the above carrier materials are associated with many drawbacks. The structure of the materials will always vary between different batches, and also within the material, due to the random distribution of the fibres e.g. in a fibrous material, or cavities e.g. in a gel-like material. Similarly, the chemical properties of the material, e.g. the distribution of chemicals added to the material, will inevitable vary for the same reasons as above.

WO 03/103835 discloses micro fluidic systems comprising a substrate, and, provided on said substrate, at least one flow path interconnecting with functional means in which liquid samples can be subjected to different desired procedures, said flow path comprising a plurality of micro posts protruding form said substrate.

The objective of the present invention is to further develop the micro fluidic systems disclosed WO 03/103835, and in particular to make available means for controlling or regulating the flow, including enhancing or attenuating the flow of liquid samples, reagents or other components on said substrate.

SUMMARY OF THE INVENTION

The present invention makes available a device for the detection of an analyte in a liquid sample, or a component of such device, said device comprising a flow path with at least one zone for receiving the sample, and a transport or incubation zone, said zones connected by or comprising an area having projections substantially vertical to its surface, wherein said device further comprises a sink with a capacity of receiving and/or absorbing said liquid sample and supporting or controlling the flow rate of said sample through said transport or incubation zone, said sink comprising an area having projections substantially vertical to its surface, and said sink being adapted to respond to external influence regulating its capacity to receive said liquid sample.

The invention also encompasses embodiments of said device and method, as set forth in the description and claims.

SHORT DESCRIPTION OF THE DRAWINGS

Figure 2:
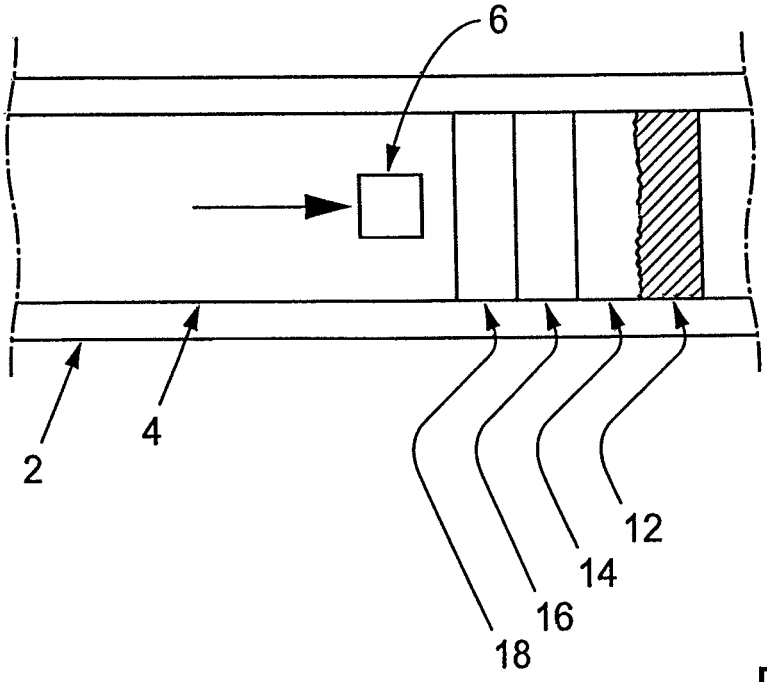
Figure 3:
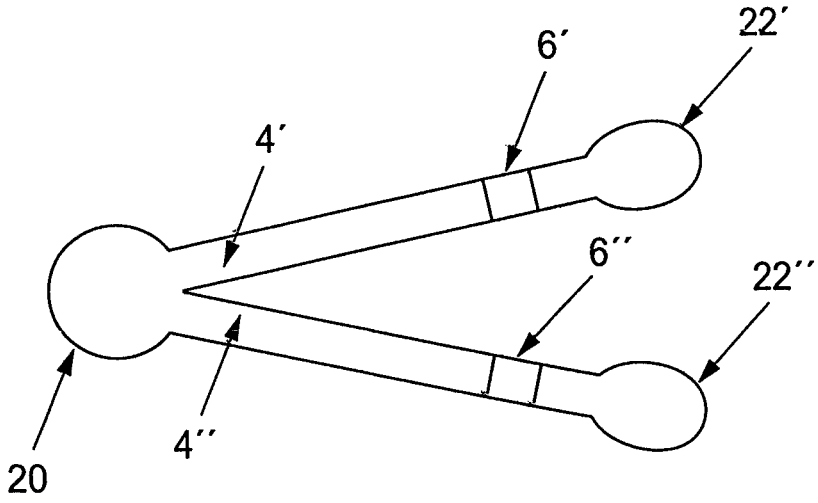

The invention will be described in closer detail in the following description, examples, and attached drawings, in which FIG. 1 schematically shows a cross section of a device according to the invention, where a means for heating causes evaporation of liquid at one end, thus driving the flow along the flow path of the device;

FIG. 2 schematically shows a top view of a device according to the invention, where the heating is performed in zones, starting from the zone most distal to the point where the sample is added;

FIG. 3 schematically shows an embodiment of the invention where two parallel determinations can be performed, the flow rate and thereby incubation time individually adjusted in the two flow paths.

Figure 4:
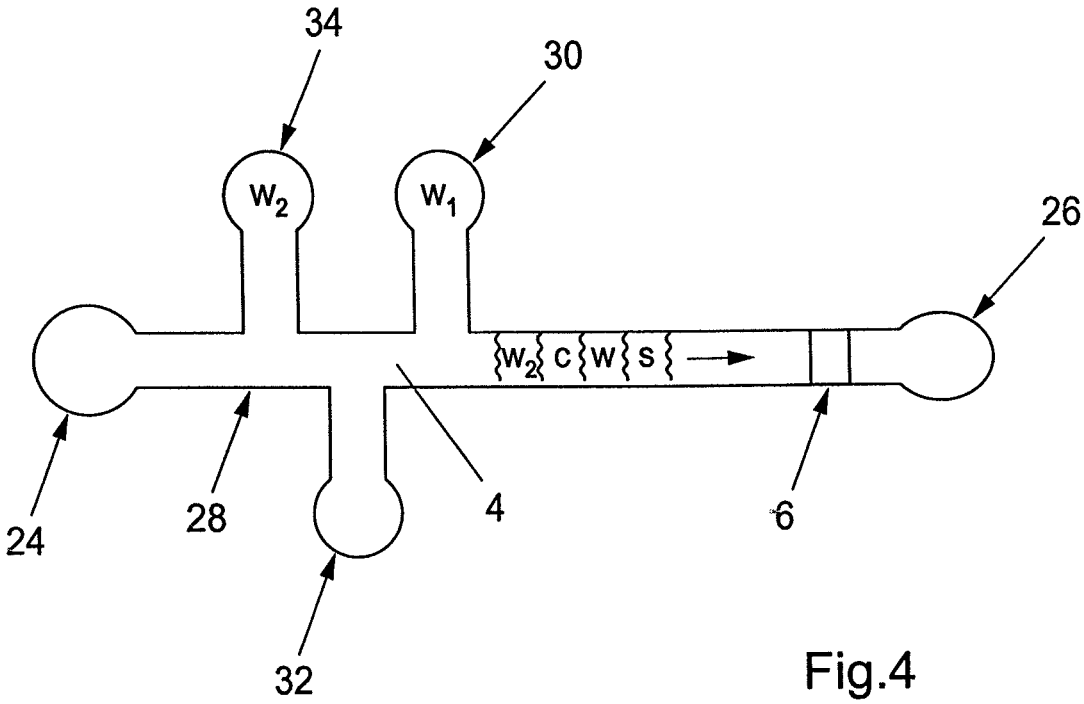
Figure 5:
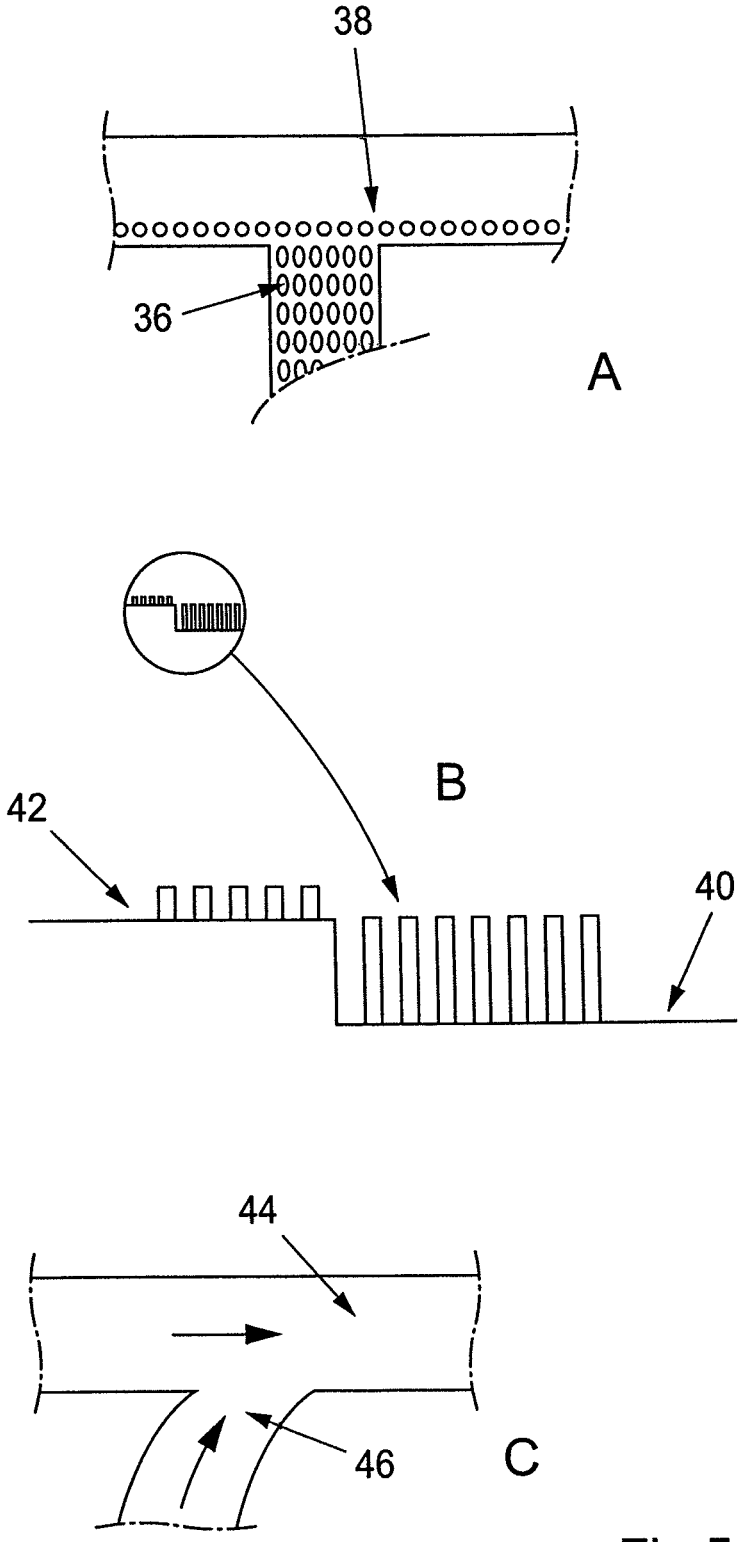

FIG. 4 schematically shows another embodiment where sample, reagents and buffers can be serially added and transported along a flow path in a controlled manner; and FIG. 5 shows different embodiments, illustrating how the transition from one flow path to another can be arranged: A) using a difference in the geometry of the micro posts; B) using a difference in the height and spacing of the micro posts; and C) using the design of the connection between the flow paths.

DESCRIPTION

Definitions

Before the present device and method is described, it is to be understood that this invention is not limited to the particular configurations, method steps, and materials disclosed herein as such configurations, steps and materials may vary somewhat. It is also to be understood that the terminology employed herein is used for the purpose of describing particular embodiments only and is not intended to be limiting since the scope of the present invention will be limited only by the appended claims and equivalents thereof.

It must also be noted that, as used in this specification and the appended claims, the singular forms "a", "an", and "the" include plural referents unless the context clearly dictates otherwise. Thus, for example, reference to a reaction mixture containing "a monoclonal antibody" includes a mixture of two or more antibodies.

The term "about" when used in the context of numeric values denotes an interval of accuracy, familiar and acceptable to a person skilled in the art. Said interval can be ±10% or preferably ±5%.

In describing and claiming the present invention, the following terminology will be used in accordance with the definitions set out herein.

The term "sample" here means a volume of a liquid, solution or suspension, intended to be subjected to qualitative or quantitative determination of any of its properties, such as the presence or absence of a component, the concentration of a component, etc. The sample may be a sample taken from an organism, such as a mammal, preferably a human; or from the biosphere, such as a water sample, or an effluent; or from an technical, chemical or biological process, such as a process of manufacturing, e.g. the production of medicaments, food, feed, or the purification of drinking water or the treatment of waste effluents. The sample may be subjected to qualitative or quantitative determination as such, or after suitable pre-treatment, such as homogenization, sonication, filtering, sedimentation, centrifugation, heat-treatment etc.

Typical samples in the context of the present invention are body fluids such as blood, plasma, serum, lymph, urine, saliva, semen, gastric fluid, sputum, tears etc.; environmental fluids such as surface water, ground water, sludge etc.; and process fluids such as mil, whey, broth, nutrient solutions, cell culture medium, etc. The present invention is applicable to all samples, but preferably to samples of body fluids, and most preferably to whole blood samples.

The determination based on lateral flow of a sample and the interaction of components present in the sample with reagents present in the device and detection of such interaction, either qualitatively or quantitatively, may be for any purpose, such as diagnostic, environmental, quality control, regulatory, forensic or research purposes. Such tests are often referred to as chromatography assays, or lateral flow assays, as in e.g. immunochromatography assays.

Examples of diagnostic determinations include, but are not limited to, the determination of analytes, also called markers, specific for different disorders, e.g. chronic metabolic disorders, such as blood glucose, blood ketones, urine glucose (diabetes), blood cholesterol (atherosclerosis, obesitas, etc); markers of other specific diseases, e.g. acute diseases, such as coronary infarct markers (e.g. troponin-T), markers of thyroid function (e.g. determination of thyroid stimulating hormone (TSH)), markers of viral infections (the use of lateral flow immunoassays for the detection of specific viral antibodies); etc.

Another important field of diagnostic determinations relate to pregnancy and fertility, e.g. pregnancy tests (determination of i.a. human chorionic gonadotropin (hCG)), ovulation tests (determination of i.a. luteneizing hormone (LH)), fertility tests (determination of i.a. follicle-stimulating hormone (FSH)) etc.

Yet another important field is that of drug tests, for easy and rapid detection of drugs and drug metabolites indicating drug abuse; such as the determination of specific drugs and drug metabolites (e.g. THC) in urine samples etc.

The term "analyte" is used as a synonym of the term "marker" and intended to encompass any substance that is measured quantitatively or qualitatively.

The terms "zone", "area" and "site" are used in the context of this description, examples and claims to define parts of the flow path on a substrate, either in prior art devices or in a device according to the invention.

The term "reaction" is used to define any reaction, which takes place between components of a sample and at least one reagent or reagents on or in said substrate, or between two or more components present in said sample. The term "reaction" is in particular used to define the reaction, taking place between an analyte and a reagent as part of the qualitative or quantitative determination of said analyte.

The term "substrate" here means the carrier or matrix to which a sample is added, and on or in which the determination is performed, or where the reaction between analyte and reagent takes place.

The term "chemical functionality" comprises any chemical compound or moiety necessary for conducting or facilitating the assay. One group of chemical compounds, with particular relevance in the present invention, are compounds or components exhibiting specific affinity to, or capability of binding or interacting with, one or more components in the sample. Red blood cell separating agents constitute an illustrative example. Such agents may be any substance capable of aggregating or binding red blood cells.

The term "biological functionality" comprises all biological interactions between a component in a sample and a reagent on or in the substrate, such as catalysis, binding, internalization, activation, or other biospecific interaction. Suitable reagents include, but are not limited to, antibodies, antibody fragments and derivates, single chain antibodies, lectines, DNA, aptamers, etc., including other polymers or molecules with binding capacity. Such reagents can be identified by a person skilled in the art, following the choice of the component to be separated, using standard experimentation, e.g. screening methods and chemical libraries.

The term "physical functionality" here comprises functionalities involved in reactions and interactions other than those that are mainly chemical or biological. Examples include diameter, height, shape, cross section, surface topography and surface patterns, the number of projections per unit area, wetting behavior of the surface of said projections, or a combination thereof, and/or other functionalities influencing the flow, retention, adhesion or rejection of components of the sample.

The distinctions between chemical, biological and physical interactions are not always clear, and it is possible that an interaction—such as an interaction between a component in a sample and a reagent on the substrate—involves chemical, biological as well as physical elements.

The terms "hydrophilic" and "hydrophobic", as in hydrophilic or hydrophobic compounds, hydrophilic or hydrophobic interactions etc., have the meaning generally understood by a person skilled in the art, and corresponding to that used in generally recognised textbooks.

DESCRIPTION OF PREFERRED EMBODIMENTS

The present invention makes available a device for handling liquid samples, said device comprising a flow path with at least one zone for receiving the sample, and a transport or incubation zone, said zones connected by or comprising an area having projections substantially vertical to its surface, wherein said device further comprises a sink with a capacity of receiving said liquid sample and supporting or controlling the flow rate of said sample through said transport or incubation zone, said sink comprising an area having projections substantially vertical to its surface, and said sink being adapted to response to external influence regulating its capacity to receive said liquid sample.

The device according to the invention can also comprise two or more flow paths, each connected to a sink, said device being adapted for performing multiple analyses on one sample. In this case, each flow path comprises a reaction zone, and individual reagents, such as conjugates, buffers etc are added to or stored in each flow path or reaction zone. A device according to this embodiment is advantageous, as it makes it possible to perform multiple analyses in parallel or substantially in parallel, starting from one sample, added to one device.

According to one embodiment, multiple reagents, buffers, etc are serially added to one flow path. This means that each one of sample, reagent, buffer etc will ravel along the flow path and pass the reaction zone in a predetermined order. Using the sink, and in particular a heated sink, the flow speed of each component can be controlled. This makes it possible to perform an e.g. analysis involving a slow pre-treatment, an incubation of a predetermined length, followed by a rapid rinse etc, only to mention an example.

According to the invention, the external influence regulating the capacity of said sink to receive said liquid sample is chosen among heating, cooling, irradiation with visible light, infrared irradiation, vibration, and the application of an electric current.

According to an embodiment of the invention, the sink is divided into sub sections, suitable for being serially subjected to said external influence. This is advantageous e.g. in instances where the sample tends to coagulate, denaturate or simply to dry in the sink during the heating. By serially heating sections of the sink, starting from the most distal one, it is possible to retain the aspirating or absorbing capacity of the sink.

One embodiment of the invention concerns the provision of means or design measures creating a preferred direction of flow within the device. Such means or measures can comprise vertical projections have different cross section in different zones of the flow path, different spacing between said projections, different chemical or biochemical treatment of said projections, a difference in the level of said flow paths, such as forming steps or thresholds between different sections of the flow path etc.

The direction of flow, e.g. the prevention of undesired back flow of sample is chosen among suitable design of the flow paths, the cross section of the substantially vertical projections, an external influence chosen among heating, cooling, irradiation with visible light, infra red irradiation, vibration, and the application of an electric current, or a combination thereof, acting on at least part of said flow paths.

The present invention makes available a chemical or biochemical assay involving a reaction between an analyte in a sample and one or more reagents, wherein the sample is added to a device as defined above. The reaction between said analyte and one or more reagent may be any conventional reaction, presently performed on a solid substrate or in a carrier material. This also comprises assays where a device according to the invention is used for the pre-treatment of the sample.

The present invention also makes available chemical or biochemical assay involving a reaction between an analyte in a sample and one or more reagents, wherein said reaction itself and/or the reading of the result is performed on a device as defined above.

The invention also makes available a method for handling liquid samples, wherein a device as defined above is used.

The device according to the invention is advantageously used in analytical applications where the liquid sample contains particulate matter, such as cells, tissue debris, organic or inorganic matter, other contamination etc, which is desired to separate from the bulk of the sample. One important application is when the liquid sample is whole blood and in such cases, the lateral capillary flow involves the separation of red blood cells from plasma without significant rupture of said cells. According to one embodiment, such separation in general, and in particular the gentle separation of red blood cells, is achieved in a gradient of projections wherein the spacing decreases from about 7 μm to about 1 μm over the length of said filtering zone.

According to one embodiment said receiving zone forms a basin for components separated from the lateral flow, e.g. particulate matter or cells prevented from passing between the projections, or entering that space only to a limited degree.

According to another embodiment the particulate matter travels with the lateral flow. In applications where said liquid sample is whole blood, it is important that said lateral capillary flow involves the transportation of red blood cells without significant rupture of said cells. This is achieved by the present invention through the control of one or more of the parameters of the projections, such as the height, diameter and reciprocal spacing, as well as the chemical or biochemical derivatisation of the projections.

The spacing between said projections can be varied depending on the intended use and the properties of the liquid sample, as well as the properties of components to be separated or transported, and preferably is in the interval of 1 to 100 μm, more preferably in the interval of 1 to 50 μm. The distance between said projections can be chosen by a skilled person, considering which sample the device is intended for, the properties of said sample, and the properties of the components that are to be separated.

The device according to the present invention is built on a plastic substrate, preferably thermoplastic, or a substrate having a plastic upper layer. This can in turn be coated or derivatised, e.g. using techniques such as sputtering, vapour deposition and the like, and given a coating of silicon, a metal or other. The present invention can also be made of silicon substrates. According to a preferred embodiment the substrate is given a hydrophilic treatment or coating, e.g. by subjecting the substrate to an oxidative treatment, such as e.g. gas plasma treatment, coating with a hydrophilic substrate such as silicon oxide, hydrophilic polymers such as dextran, polyethylene glycol, heparin and derivatives thereof, detergents, biologic substances such as polymers, etc.

Consequently, according to one embodiment of the invention, said projections or at least a sub-set thereof are provided with a chemical, biologic or physical functionality. The projections may have chemically reactive groups on their surface. The projections may also have substances with biological affinity bound to their surface.

According to another embodiment, the projections carry structures or groups chosen among hydrophilic groups, hydrophobic groups, positively and/or negatively charged groups, silicon oxide, carbohydrates, amino acids, nucleic acids, and macromolecules, or combinations thereof.

According to yet another embodiment, the projections have a physical property selected from the projection diameter, height, reciprocal spacing, shape, cross section, surface coating, the number of projections per unit area, wetting behavior of the surface of said projections, or a combination thereof, according to the desired end use of the substrate.

According to another embodiment, particles are provided chemically or physically bound to the substrate, or mechanically trapped within a region comprising a plurality of projections. Said particles are chosen among commercially available particles, so called beads, and may have a core of glass, metal or polymer, or a combination of these, and they optionally carry on their surface chemical or biological moieties, such as polyclonal antibodies, monoclonal antibodies, amino acids, nucleic acids, carbohydrates or combinations thereof.

The present invention also makes available a device suitable for use in or together with a device for detection of an analyte in a liquid sample, wherein said device has projections substantially vertical to its surface, said projections having a height, diameter and reciprocal spacing such, that said device is capable of separating components of said liquid sample while achieving a lateral flow of said liquid sample. This device may have one or more of the properties and functionalities described above, depending on its intended use.

This device may be used separately, in association with, or integrated in a device for the analysis of a liquid sample. This device may function as a pre-treatment step in or before a conventional analysis.

The present invention also makes available a method for performing an assay on a liquid sample, said sample being applied to a substrate having a zone for receiving the sample, which is in fluid connection with a reaction zone, and optionally a transport or incubation zone connecting the receiving and reaction zone, respectively, wherein said substrate is a non-porous substrate, and said receiving zone, reaction zone and optional transport or incubation zone consist of areas of projections substantially vertical to said surface, and having a height, diameter, and reciprocal spacing such, that lateral capillary flow of said liquid sample in said zone is achieved.

According to one embodiment of this method, a filtering step is performed following the addition of the sample, said filtering effected in a filtering zone by projections substantially vertical to the surface of said substrate, the projections having a height, diameter, and reciprocal spacing forming a gradient with regard to the diameter, and/or reciprocal spacing such that components of the sample are gradually retained.

This method can be used for all applications where components of a liquid sample need to be separated from the bulk of the sample. The method is however particularly suitable for applications where said liquid sample is whole blood and said lateral capillary flow involves the separation of red blood cells from plasma without significant rupture of said cells.

One way to achieve a gentle separation of components of the sample, is to subject the sample to a filtering zone where the spacing between the projections gradually decreases. In applications where the lateral capillary flow involves the separation of red blood cells from plasma, it is important that this takes place without significant rupture of said red blood cells. Ito achieve this, in applications involving the separation of red blood cells, the spacing preferably decreases from about 7 μm to about 1 μm over the length of said filtering zone.

According to one embodiment of the method, components separated from the lateral flow are retained in a basin, substantially prevented from entering the filtering zone.

Another embodiment, in applications where said liquid sample is whole blood, is a method of achieving a lateral capillary flow involving the transportation of red blood cells without significant rupture of said cells. And if needed a flow of buffer liquid can be used to reduce the amount of cells in the reaction zone, promoting the detection step.

The invention also makes available a method for performing an assay on a liquid sample, in particular a sample of whole blood, wherein said sample is added to a device as described above.

The device according to the present invention surprisingly replaces prior art devices where the substrate, and/or one or more of said zones were made of a porous material such as nitrocellulose, cellulose, asbestos fibres, glass fibres and the like.

A general embodiment is schematically shown in FIG. 1, showing a part of a device where the surface of a substrate 1 has a flow path 4 comprising projections substantially vertical to said surface, and having a height, diameter and reciprocal spacing such, that lateral capillary flow is achieved. A reaction zone 6 is provided on said surface, and it is desired that sample and optionally reagents, buffers is/are transported laterally so that they pass said reaction zone. It is further desired that the rate, at which said reagents etc pass the reaction zone is controlled. To this end, a sink 8 is provided at the distal end of the substrate, in relation to the place where sample is added. This sink is then heated by heating means 10, in order to evaporate liquid and control or increase the flow rate of the sample.

Another embodiment is illustrated in FIG. 2, showing a part of a substrate 2 having a flow path 4 and a reaction zone 6. The sink is however divided into zones 12, 14, 16, and 18, which can be heated consecutively, starting from the most distal zone 12.

Yet another embodiment is illustrated in FIG. 3, where sample is added to one location 20 in fluid connection with two flow paths 4' and 4", each flow path passing a reaction zone 6' and 6", and ending in a sink, 22' and 22", respectively. By giving the sinks 22' and 22" different capacity, or by subjecting them to heating, it becomes possible to achieve different flow rates in the flow paths 4' and 4". This is advantageous in applications where two or more determinations are to be performed on the same sample, and each determination has its own requirements as to incubation time, reaction time, flow rate etc. While FIG. 3 only shows two flow paths, it is understood that three, four or several parallel flow paths could be provided.

FIG. 4 illustrates an embodiment where sample is added to one location 24, in a system 28 forming a fluid connection between sample addition 24, a flow path 4, a reaction zone 6 and a sink 26, where a first wash buffer $W_1$ stored in or added to another location 30, a conjugate C stored in or added to 32, and a second wash buffer $W_2$ stored in or added to 34, can be serially introduced onto said flow path 4. When $W_1$, $W_2$, and C are added simultaneously, the distance between 30, 32, and 34; and the flow path 4, respectively, can be varied in order to influence the time it takes $W_1$, $W_2$, and C to reach the flow path. When $W_1$, $W_2$, and C are stored on the surface, at the locations 30, 32, and 34, respectively, the release of these components can be controlled by the provision of meltable seals, the heating or cooling of the components, or other means, influencing the time it takes $W_1$, $W_2$, and C to reach the flow path. While 30, 32, and 34 are schematically shown in FIG. 4 to be at an approximately equal distance from the flow path 4, and approximately vertical thereto, it is contemplated that they can be at different distances, at an angle to the flow path, or even partially thereto. Centrifugation is contemplated as one means to deliver one or all of $W_1$, $W_2$, and C to the flow path.

FIG. 5A schematically illustrates an embodiment where the transition from one flow path 36 into another low path 38 is characterized in that the substantially vertical projections in said flow paths have different properties, said properties chosen so that the direction of flow is controlled, e.g. creating a preferred direction of flow. Different properties in this respect can be different cross section, height, orientation, spacing, and surface chemistry of the projections, or a combination thereof.

FIG. 5B schematically illustrates another embodiment where not only the properties of said projections, but also the level of the flow paths are different, again in order to create a preferred direction of flow.

Finally, FIG. 5C schematically illustrates an embodiment where the geometry of the respective flow paths 44 and 46 has been designed to create a preferred direction of flow.

The above embodiments may also be combined, e.g. by taking features from one embodiment and introducing these in another.

ADVANTAGES OF THE INVENTION

An advantage of the device according to the invention is the possibility to accurately control the flow rate, including possibilities to stop and start the flow. This in turn makes it possible to perform simultaneous or sequential reactions, either in series or in parallel, in a controlled fashion. It is also possible to influence the incubation time of different reactions.

Another advantage of the device is that, due to the open, regular structure and the defined properties of the capillary flow zones, the addition of reagents these zones or the derivatisation of the surface of the projections is greatly simplified.

Yet another advantage of the device is the uniformity of the structure not only within a single device, but also between all devices produced. This result in significantly increased reliability and repeatability of the assays built on the inventive device.

An important advantage of the inventive device is that the degree of separation, from none to total, of the blood cells, can be accurately controlled.

The inventive device has many advantages with respect to the manufacturing process. All capillary zones can be made in one step and no assembly of parts is required. Optionally, a cover having at least one aperture for sample addition and one reading the result of the assay can be placed over the substrate and the capillary zones.

Although the invention has been described with regard to its preferred embodiments, which constitute the best mode presently known to the inventors, it should be understood that various changes and modifications as would be obvious to one having the ordinary skill in this art may be made without departing from the scope of the invention which is set forth in the claims appended hereto.

The invention claimed is:

1. A method of performing an assay on a liquid sample for the detection of one or more analytes of interest, said method comprising the steps of:

providing a substrate having a non-porous support surface, said non-porous support surface having at least one capillary flow zone, said at least one capillary flow zone being defined by at least one plurality of microstructures projecting from said support surface of said substrate that induce lateral capillary flow of an introduced liquid sample along at least one flow path;

providing a sample receiving zone on said substrate for receiving said liquid sample;

providing a reaction or incubation zone on said substrate in relation to said at least one capillary flow zone, said reaction or incubation zone having a material having at least one of a chemical or biological functionality, wherein said sample receiving zone is disposed in relation to said at least one capillary flow zone and said reaction or incubation zone for producing an initial lateral capillary flow of said liquid sample;

providing a sink downstream in relation to the sample receiving zone and said reaction or incubation zone along said at least one flow path of said at least one capillary flow zone, said sink having a capacity to receive the liquid sample along said at least one flow path and to support or control the flow rate of the sample through the reaction or incubation zone;

dispensing a quantity of a sample onto the sample receiving zone, whereby the sample flows by capillary action along said at least one flow path of said at least one capillary flow zone through the reaction or incubation zone and into the sink; and taking a reading to determine the presence or concentration of the one or more analytes; said method further comprising the step of providing an external influence to the sink to regulate the capacity of the sink to receive the liquid sample and wherein the external influence to the sink is selected from the group comprising cooling, irradiation with visible light, heating, infrared irradiation, vibration and application of electric current and wherein said external influence providing step includes the step of dividing said sink into a plurality of zones, said zones being serially subjected to said external influence in order to regulate the capacity of said sink.

2. A method as recited in claim 1, including the step of regulating the flow rate of said liquid sample through said incubation zone.

3. A method as recited in claim 2, wherein the regulating step is performed by providing said external influence to said sink.

4. A method as recited in claim 1, wherein said method further includes the step of heating at least one zone of said sink to evaporate said liquid sample therefrom and in which said heating step is serially initiated beginning at a zone of said sink located furthest downstream relative to said sample receiving zone and in which evaporation of liquid sample creates dried sample in the zone subjected to heating thereby preventing additional flow of sample into said distalmost zone of said sink.

5. A method as recited in claim 1, including the step of providing said at least one flow path with microstructures comprising said vertical projections, said providing step further including the step of providing said vertical projections with different cross sections in different portions of said at least one flow path.

6. A method as recited in claim 1, including the step of providing at least two flow paths extending from a single sample receiving zone, each of said at least two flow paths including a reaction or incubation zone and a sink disposed along a separate capillary flow zone extending from said sample receiving zone.

7. A method as recited in claim 1, further including the step of providing at least two flow paths, each said flow path being connected to a common sink.

8. A method as recited in claim 7, wherein said at least two flow paths are connected to a common reaction or incubation zone.

9. A method as recited in claim 6, including the step of performing multiple assays in parallel by detecting the presence or concentration of analyte in each of said at least two flow paths following the dispensing of sample to said single sample addition zone.

10. A method as recited in claim 1, including the step of providing a plurality of said sample receiving zones in relation to a common sink and providing a single flow path extending between said reaction or incubation zone and said sink, said method including the step of serially adding a quantity of sample and at least one reagent to said sample receiving zones in a predetermined order including the step of controlling the flow rate of each received sample across said reaction or incubation zone by means of applying the external influence to said common sink.

11. A method as recited in claim 1, including the step of performing said assay and in which capillary flow of sample along said at least one flow path can be accomplished without requiring a cover for said device.

12. A method as recited in claim 11, including the step of providing a cover, said cover including at least one aperture for enabling sample to be added to said sample receiving zone.

* * * * *